United States Patent [19]

Stolp

[11] 4,142,566

[45] Mar. 6, 1979

[54] BINOCULAR CASE

[75] Inventor: Myron G. Stolp, Arcadia, Calif.

[73] Assignee: Bausch & Lomb Incorporated, Rochester, N.Y.

[21] Appl. No.: 865,229

[22] Filed: Dec. 28, 1977

[51] Int. Cl.[2] ..... A45C 11/08

[52] U.S. Cl. ..... 150/52 J; 206/45.17; 206/316

[58] Field of Search ..... 150/52 J; 206/45.13, 206/45.17, 45.18, 316

[56] References Cited

U.S. PATENT DOCUMENTS

| | | | |
|---|---|---|---|
| 701,401 | 6/1902 | Schrader | 206/45.17 |
| 2,223,219 | 11/1940 | Mayerovitz | 150/52 J |
| 2,988,125 | 6/1961 | Reynolds | 150/52 J |
| 3,353,657 | 11/1967 | Young | 206/45.13 |
| 3,813,017 | 5/1974 | Pimsleur | 150/52 J |

FOREIGN PATENT DOCUMENTS

| | | | |
|---|---|---|---|
| 1071588 | 6/1967 | United Kingdom | 150/52 J |

*Primary Examiner*—Donald F. Norton
*Attorney, Agent, or Firm*—Christie, Parker & Hale

[57] ABSTRACT

A binocular case having a wall which is hinged to the case, the hinged wall defining a tray for supporting the binocular within the case. When the hinged wall is moved to an open position, the binocular moves with the wall to be accessible for withdrawal from the case with one hand, and is in a proper position to be moved directly to the eyes of the user for immediate viewing without requiring binocular inversion or other major repositioning and regripping of the instrument.

7 Claims, 6 Drawing Figures

BINOCULAR CASE

BACKGROUND OF THE INVENTION

Binoculars are widely used for viewing of sporting events, nature study, spotting of game, and a wide variety of other uses where a magnified image of a remote scene is desired. To insure that the binocular body and lens surfaces are properly protected during storage and while being carried, the instrument is normally provided with a case which is typically made of leather or plastic.

A traditional binocular case is a roughly rectangular box shaped to accommodate a particular binocular size and body style. The case top is hinged to enable removal of the binocular for viewing use. Some cases hold the binocular in an inverted vertical position with the objective lenses facing the top, but other modern designs support the instrument in an upright position with the eyepieces or ocular lenses facing the case top. The case is typically provided with a neckstrap, and with a snap fastener or other retainer to hold the top cover in a closed position.

A conventional case provides good protection for the binocular, and is satisfactory at sporting events and in similar uses where the binocular is withdrawn from the case and supported from a neckstrap to be accessible for immediate viewing throughout the event. There are, however, many other applications where the instrument may be only occasionally used, and it is preferably held in the protective case until a viewing need arises. Typical examples of these applications arise in hiking, bird watching and other nature studies, and during general vacation travel where the user is moving about rather than being seated, and where occasional rather than constant access to a binocular is expected.

A problem with the conventional binocular case in these applications is that the case lid is awkward to open, and the binocular is not in a position for immediate viewing when withdrawn from the case. If the conventional case is being carried on the side of the body with the strap positioned over the user's shoulder, the case usually is moved to the front of the body to provide access to the hinged lid and to the instrument. The body of the case is typically steadied with one hand, and the other hand releases the lid catch and moves the lid to an open position. One hand is then used to steady the case and hold the lid open, and the other hand is inserted into the case to grasp the binocular and raises it upwardly out of the case.

When the binocular has been removed from the case, it is usually not in a position to be moved immediately to the eyes, and the instrument must be regripped with one or both hands before a comfortable and steady grasp is achieved. The user may also want to shift the case back to the hip after removing the binocular to avoid having the case interfere with a camera or other neckstrap-supported equipment being carried. The steps involved in removing and replacing a binocular are thus sufficiently awkward and cumbersome that many people are unwilling to suffer these inconveniences in order to have the benefits of binocular viewing.

The case of this invention overcomes these drawbacks of a conventional case, and enables the binocular to be withdrawn or replaced in an easy motion which normally does not require any repositioning of the case with respect to the user's body. An important advantage of the new case is that the binoculars are positioned by the opened case to be grasped, withdrawn, and immediately moved to the eyes without inversion or grip repositioning. The binocular can be removed and replaced with a single hand, while the case remains in a position which does not interfere with the user's hands and arms, or with other neckstrap supported devices such as a camera.

SUMMARY OF THE INVENTION

This invention relates to a binocular case having a moveable wall or panel which carries or is connected to a binocular-supporting tray disposed within the case body or housing when the case is closed. The moveable wall is hinged or otherwise moveably connected to the case body, and is shifted in position to open the case. Movement of this wall shifts the position of the binocular-supporting tray to carry the binocular at least partially out of the case so the instrument can be easily and quickly grasped without groping in the case interior.

An important feature of the invention is that the binoculars are oriented upon opening the case to be gripped in the same fashion as when the instrument is held for viewing. This orientation eliminates any grip shifting after the binocular is removed from the case, and enables immediate movement to the eyes. This same feature permits the binocular to be quickly and easily replaced in the case.

DESCRIPTION OF THE PREFERRED EMBODIMENT

Figure 1:
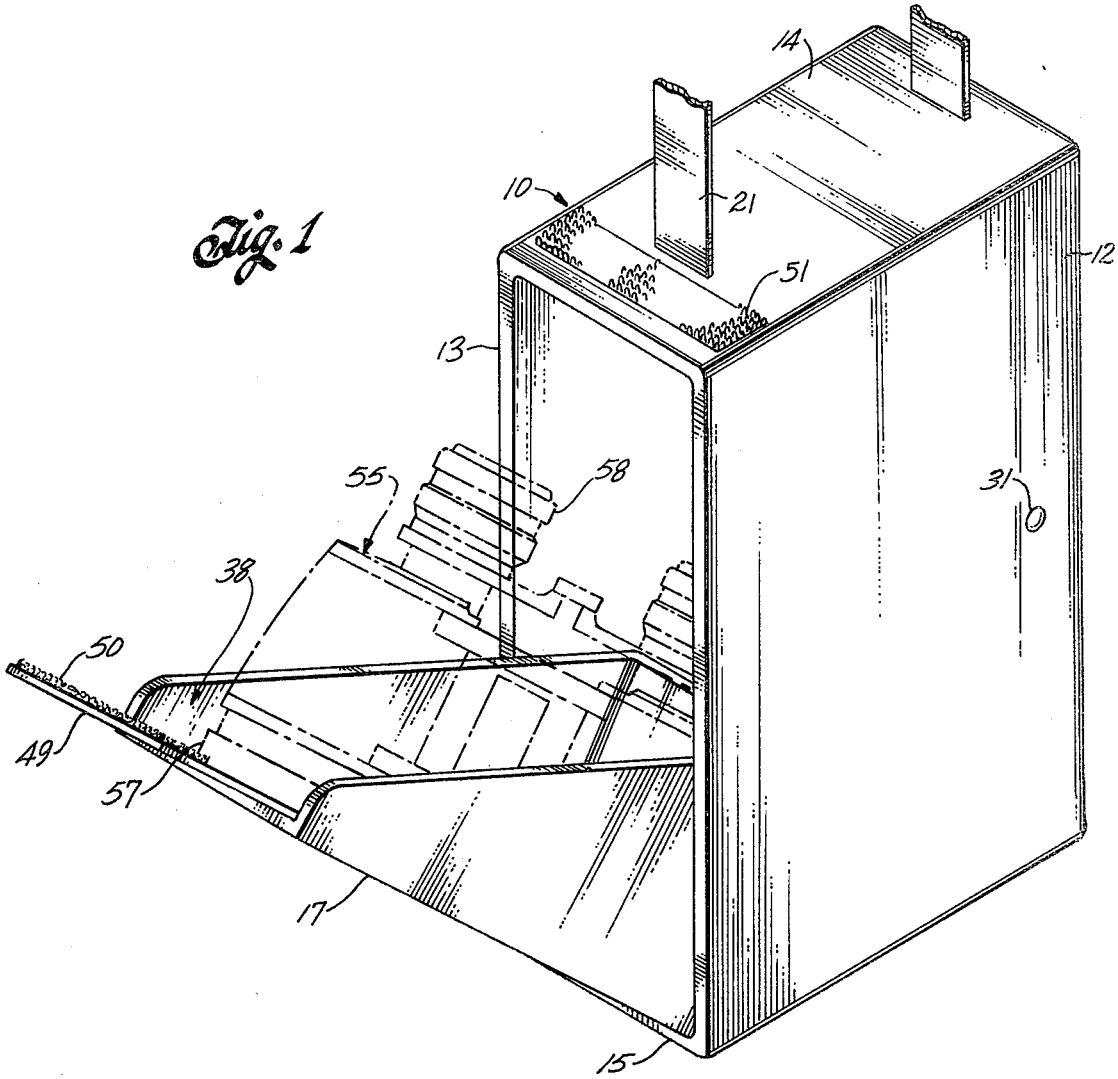
FIG. 1 is a perspective view of a binocular case according to the invention, the case being in an open position and supporting a binocular (shown in phantom line)

A binocular case 10 according to the invention is shown in FIGS. 1–3 and 6. The case is preferably made from a rugged, scuff-resistant laminated plastic material. In a presently preferred form, the exterior of the case is a leather-simulating vinyl plastic with a foam-plastic backing which is in turn bonded to a central stiffening sheet of chipboard or cardboard. The inner surface of the chipboard can be finished with leather-simulating vinyl plastic but is preferably covered with an expanded-vinyl foam-plastic material in those areas of the case interior which contact the binocular. The case can also be made from a non-laminated material such as leather, and the case material is shown for simplicity as a homogeneous sheet in the cross-sectional views of the drawings.

Case 10 is a housing formed by a front wall 12, a rear wall 13, a top wall 14, a bottom wall 15, a fixed end wall 16, and a moveable end wall 17. These panels or walls are assembled to form a box-like housing, the dimensions of which are selected to accommodate the size and shape of binocular to be stored and carried in the case.

Preferably, the front, rear, top and bottom walls are integrally formed from an initially flat rectangular sheet which is folded to form an open-ended box. The ends of the rectangular sheet are brought together in a butt joint extending along the center of the bottom wall. A pair of small spaced-apart openings 20 are formed through the top wall, and a neckstrap 21 is threaded through the openings as best seen in FIG. 2.

Figure 5:
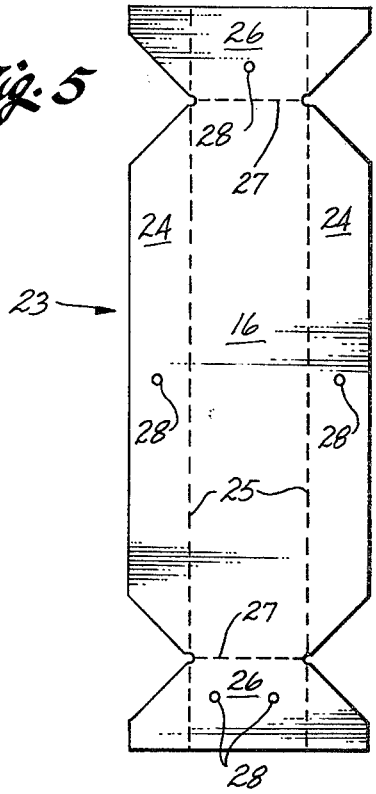
FIG. 5 is a developed view of a fixed end wall for the case.

Fixed end wall 16 is folded from an initially flat die-cut sheet or blank 23 as shown in FIG. 5. A pair of flanges 24 are formed along opposite sides of the blank, and the flanges are bent along fold lines 25 to extend perpendicularly from the plane of the blank. Similarly, a pair of tabs 26 are formed at opposite ends of the end-wall blank, and fold lines 27 are scored in the blank for these tabs. A plurality of rivet holes 28 are also formed through the blank at the time it is diecut from a sheet of case material.

Figure 3:
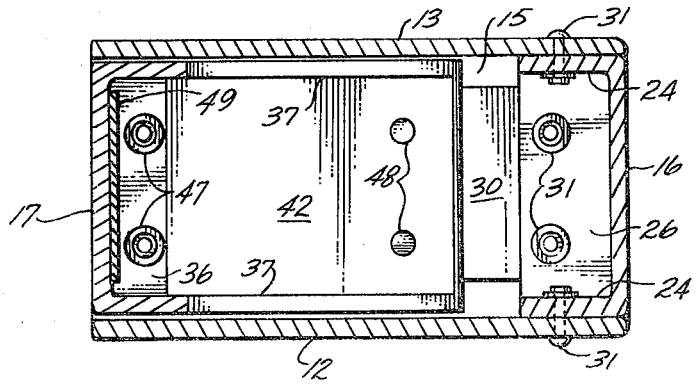
FIG. 3 is a view on line 3—3 of FIG. 2 with the case closed.
Figure 2:
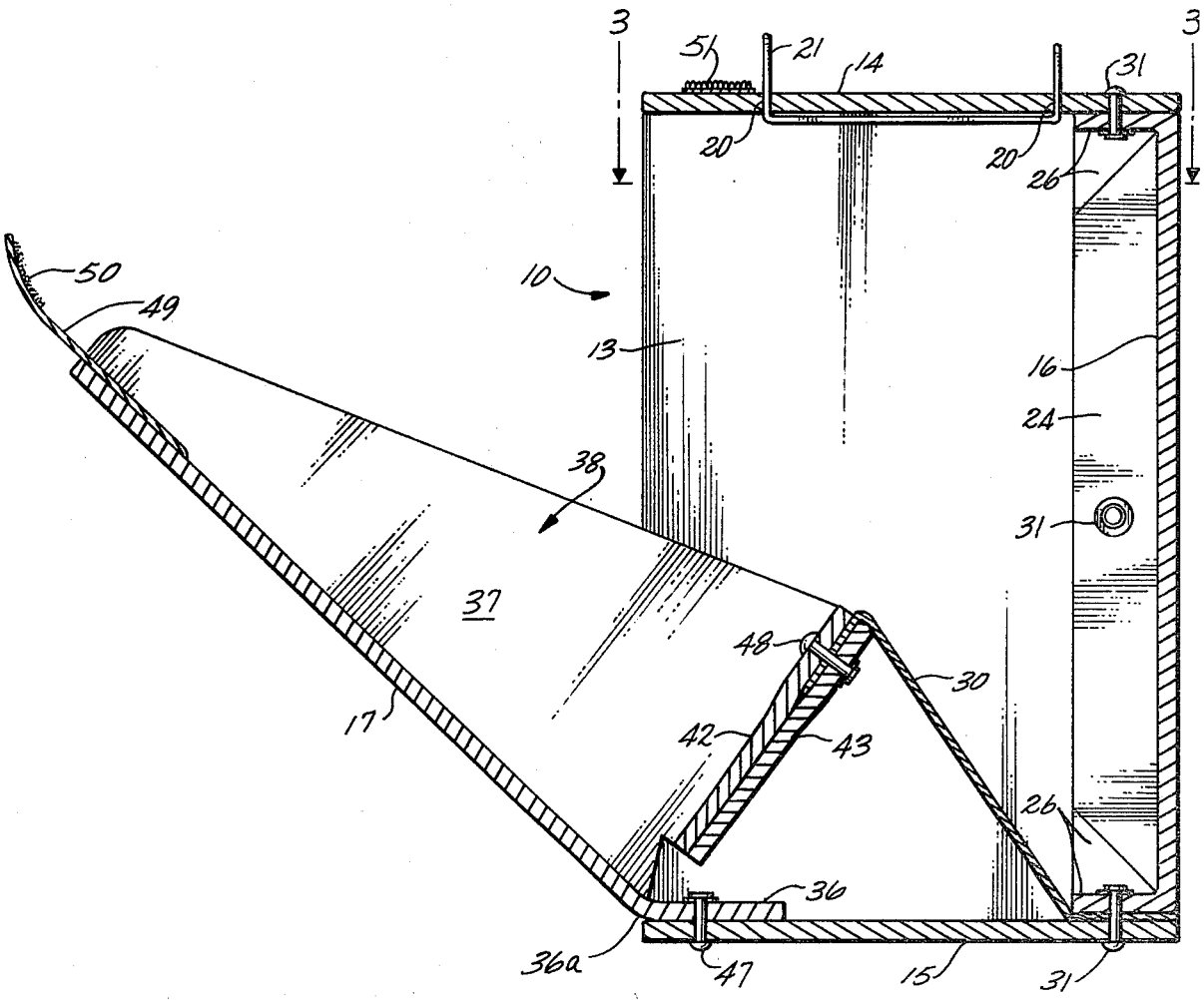
FIG. 2 is a sectional elevation of the case in an open position.

After folding flanges 24 and tabs 26 along the respective fold lines, fixed end wall 16 is slipped into the end of the partially assembled case as best seen in FIGS. 2 and 3. One end of an elongated leather or plastic retaining strap 30 is positioned between bottom tab 26 of the end wall and the upper surface of bottom wall 15 as shown in FIG. 2. These parts are then secured together with a plurality of rivets 31 or other suitable fasteners. The case parts can also be cemented together, but a riveted construction is preferred for long life and durability, and for additional rigidity of the overall case structure.

Figure 4:
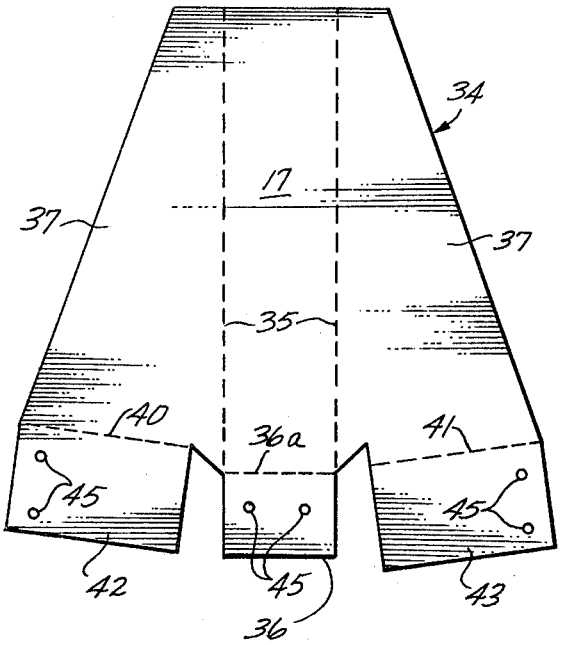
FIG. 4 is a developed view of a binocular tray for the case.

Moveable end wall 17 is formed from an initially flat blank 34 as shown in FIG. 4. Spaced-apart parallel fold lines 35 are scored in a central part of this blank to define a generally rectangular panel which will be the end wall of the case. A mounting tab 36 is an integral extension of the lower end of this rectangular panel below a fold line 36*a*. The side edges of the blank taper outwardly from top to bottom to form side panels 37 of a binocular-supporting tray 38 (FIG. 1). The tapered edges of the blank terminate at a pair of fold lines 40 and 41, and a pair of generally rectangular tray-floor tabs 42 and 43 extend downwardly from these fold lines.

Fold lines 40 and 41 slope upwardly as they extend outwardly, and the fold lines are typically at an angle of about 82° to the central longitudinal axis of the blank. The fold lines are so positioned to provide a slight slope in the tray floor as explained in greater detail below. As shown in FIG. 4, the axes of fold lines 40 and 41 are slightly vertically offset to provide proper alignment of the floor tabs when the blank is folded. A plurality of rivet holes 45 are formed through blank 34 at the time it is severed from a sheet of case material.

Mounting tab 36 is secured against the upper surface of bottom wall 15 by a pair of rivets 47 as best seen in FIG. 2. Fold line 36*a* of the floor tab defines the axis about which moveable end panel 17 hinges when moved between opened and closed positions.

Side panels 37 are bent along fold lines 35 toward each other to extend perpendicularly from end wall 17, and floor tabs 42 and 43 are then folded toward each other in over-lapping relation to be secured together by rivets 48 (FIG. 2). Prior to this riveting step, the free end of retaining strap 30 is slipped between the floor tabs to be secured thereto by the rivets.

Figure 6:
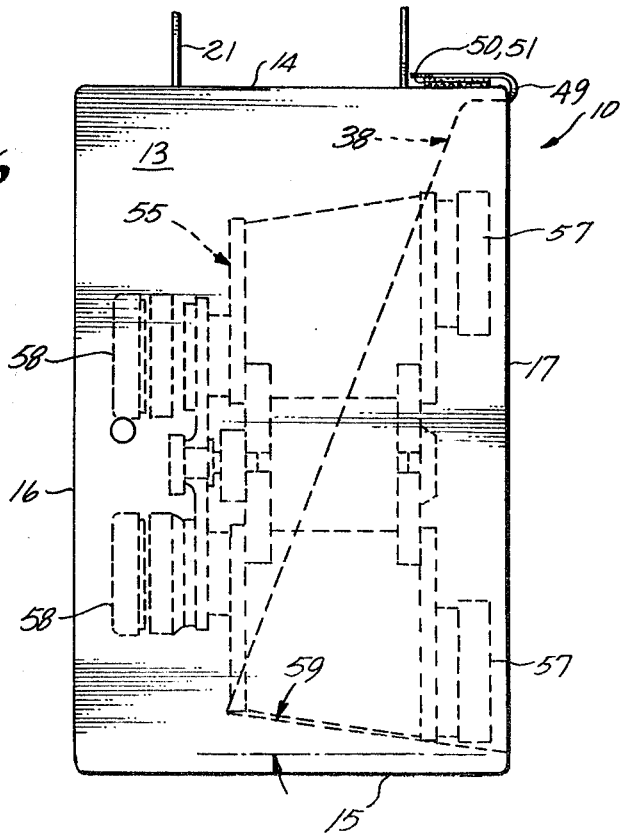
FIG. 6 is a rear elevation of the case with the binocular and tray shown in phantom line.

The lower end of a fastener strap 49 is secured along the upper end of the inner surface of end wall 17, and a fastener 50 such as a strip of hook-and-pile material (as sold under the trademark "Velcro") is mounted at the free end of the strap. A mating fastener 51 is secured to the upper surface of top wall 14, and the fasteners are pressed together to hold the case in a closed position when moveable end wall 17 is closed as shown in FIG. 6. Snaps or other types of fasteners are also suitable for securing the end wall in a closed position.

A typical binocular 55 useful with case 10 is shown in phantom line (FIGS. 1 and 6), and the binocular is inserted in the case simply by opening moveable end wall 17 and resting the binocular in tray 38 which is formed by end wall 17, side panels 37, and floor tabs 42. The body sides of most prism binoculars are slightly tapered inwardly from the objective end (lenses 57 in FIG. 6) of the instrument toward the eye-pieces (lenses 58 in FIG. 6), and the slight upward slope (designated by angle 59 in FIG. 6) of the tray floor is selected to match the binocular body taper. The purpose of this arrangement is to ensure that the inner end of the tray floor will contact the binocular body inwardly of the binocular center of gravity to avoid tipping of the instrument within the case when the tray and moveable end wall are shifted to an open position.

After the binocular is inserted in the supporting tray, the moveable end wall is shifted to a closed position, and fasteners 50 and 51 are engaged to close the case. Neckstrap 21 is then fitted over the user's neck, and the case may be supported against the front of the user's body, or at the side or rear of the body with the user's arm extending through the neckstrap. The case is often most conveniently positioned against the side or rear of the user's hip to avoid interference of the case or neckstrap with a camera or other neckstrap-supported equipment resting against the front of the body.

When the binoculars are to be used, the case is opened in a single simple motion by grasping the end of fastener strap 49 to release fasteners 50 and 51, and to move end wall 17 and the binocular-supporting tray outwardly into an open position as shown in FIG. 2. An important feature of the invention is that the binoculars are positioned in the tray so they can be withdrawn from the case and moved immediately to the user's eyes without being inverted or otherwise regripped prior to viewing use. This is so because the objective-lens end of the binocular faces and rests against the inner surface of moveable end wall 17, and the side of the binocular body can be grasped in the same position as the binocular is held in normal viewing. Replacement of the binocular in the case simply involves slipping the instrument back into the tray, and hinging the moveable end wall to a closed position where the fasteners can be engaged.

There has been described a novel binocular case having an internal tray connected to a hinged wall which is moved to open and close the case. The binocular is normally supported in the case with the optical and hinge axes of the instrument in a generally horizontal position, and shifting of the tray to an open position places the binocular in position for immediate withdrawal and movement to the user's eyes without grip shifting or other repositioning. The case is symmetrical, and is suitable for either right-or-left-handed use by simply positioning the binocular in the tray so the undersurface of the instrument faces the user's body. The tapered side panels of the tray support the binocular securely when the moveable wall is shifted to an open position, but without restricting free access to the binocular body when the instrument is removed from or replaced in the case.

What is claimed is:

1. A binocular case, comprising a housing having a moveable wall which can be shifted between a first closed position and a second open position providing access to the housing interior, and a binocular-supporting tray connected to the moveable wall to be moveable therewith, whereby shifting the moveable wall to the open position carries a binocular supported in the tray at least partially out of the housing;

the moveable wall being disposed between top and bottom walls of the case, the tray extending from the moveable wall inwardly into the case when the case is closed, the tray being configured to support the binocular within the closed case with objective lenses of the binocular facing the moveable wall;

the tray including a floor tab extending from the moveable wall at an angle of less than ninety degrees so the floor tab slopes upwardly as it extends into the case interior when the moveable wall is closed to support a side surface of the binocular.

2. A binocular case, comprising a housing having top and bottom walls, sidewalls, and first and second end walls to form an enclosure for a binocular, the first end wall being moveable with respect to the other walls to open the housing and thereby make the binocular accessible, the moveable wall having a tray portion extending into the housing to support the binocular so the binocular moves with and is carried by the moveable wall;

the tray portion being formed by the moveable end wall, a pair of spaced-apart side panels secured to and extending from opposite side edges of the moveable end wall, and a floor tab extending across lower ends of the side panels;

at least one of the side panels being configured to have a free inner edge portion which has a lesser extension toward the second end wall than the corresponding extension of the floor tab whereby several surfaces of the binocular are exposed and easily grasped when the housing is open.

3. The case defined in claim 2 wherein the floor tab extends from the moveable end wall at an angle of less than ninety degrees so the floor tab slopes upwardly as it extends into the case interior when the moveable end wall is closed.

4. The case defined in claim 3, wherein the side panels of the tray are tapered to increase in width toward the floor tab.

5. The case defined in claim 4, and further comprising a releasable fastening means on the case for securing the moveable end wall in a closed position.

6. The case defined in claim 5, and further comprising a retaining strap secured to and extending between the floor tab and a non-moveable portion of the housing to limit movement of the tray portion away from the housing.

7. The case defined in claim 6, wherein the top and bottom walls and the side walls are formed from an initially flat and generally rectangular blank which is folded into an open-ended box; and wherein the first end wall and tray portion are formed from an initially flat blank having side portions which are folded to form the tray side panels, a central portion forming the first end wall, a tab at an end of each side panel, the tabs being folded and secured togather in overlapping relationship to form the tray floor tab, and a mounting tab extending from the central portion between the side-panel tabs and being secured to the bottom wall.

* * * * *